US008752925B2

(12) United States Patent
Norigoe

(10) Patent No.: US 8,752,925 B2
(45) Date of Patent: Jun. 17, 2014

(54) DRIVING PULSE APPLICATION METHOD AND APPARATUS OF AN INK JET HEAD

(75) Inventor: Takashi Norigoe, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/603,645

(22) Filed: Sep. 5, 2012

(65) Prior Publication Data

US 2013/0063508 A1 Mar. 14, 2013

(30) Foreign Application Priority Data

Sep. 14, 2011 (JP) ..... 2011-201067
Jul. 12, 2012 (JP) ..... 2012-156622

(51) Int. Cl.
*B41J 29/38* (2006.01)

(52) U.S. Cl.
USPC ..... 347/9; 347/10; 347/11

(58) Field of Classification Search
USPC ..... 347/9–11, 14, 57, 60, 68, 70, 71
See application file for complete search history.

(56) References Cited

U.S. PATENT DOCUMENTS 6,257,687 B1 * 7/2001 Iwamura ..... 347/10

FOREIGN PATENT DOCUMENTS

| | | |
|---|---|---|
| JP | 2007-022073 | 2/2007 |
| JP | 2011-088346 | 5/2011 |
| JP | 2012-101401 | 5/2012 |

OTHER PUBLICATIONS

Japanese Office Action for Japanese Patent Application No. 2012-156622 mailed on Feb. 4, 2014.

* cited by examiner

*Primary Examiner* — Juanita D Jackson
(74) *Attorney, Agent, or Firm* — Amin, Turocy & Watson, LLP

(57) ABSTRACT

According to one embodiment, a driving method of an ink jet head includes applying a first pulse for expanding volume of a pressure chamber in which an ink is accommodated to an actuator for applying oscillation to the pressure chamber and applying a second pulse for reducing volume of the pressure chamber to the actuator immediately before ink drops discharged from a nozzle which is communicated with the pressure chamber are separated from the nozzle.

10 Claims, 7 Drawing Sheets

DRIVING PULSE APPLICATION METHOD AND APPARATUS OF AN INK JET HEAD

CROSS-REFERENCE TO RELATED APPLICATIONS

This application is based upon and claims the benefit of priority from Japanese Patent Applications No. 2011-201067, filed on Sep. 14, 2011; and No. 2012-156622, filed on Jul. 12, 2012, the entire contents of both which are incorporated herein by reference.

FIELD

Embodiments described herein relate generally to a driving method and a driving apparatus of an ink jet head used for an ink jet type of printer or the like.

BACKGROUND

Conventionally, an ink jet head used for an ink jet type of printer or the like includes a plurality of pressure chambers which accommodate ink, nozzle plates provided to one end side of each of the pressure chambers and a plurality of piezoelectric actuators provided corresponding to each of the pressure chambers. A plurality of nozzles for discharging ink drops which correspond to each of the pressure chambers are formed on the nozzle plates.

When the piezoelectric actuators are driven, pressure oscillation is applied to the pressure chambers corresponding to the actuators. Due to the pressure oscillation, the volume inside the pressure chamber is changed and the ink drops are discharged from the nozzles corresponding to the pressure chambers. The ink drops are landed on a recording medium such as a recording sheet and dots are formed on the recording medium. As such dots are consecutively formed, characters, images or the like on the basis of image data are printed on the recording medium.

In such an ink jet head, when the ink drop is discharged from the nozzle, there is a case where fine droplets which are incidental to main droplets are discharged. Such fine droplets are called satellites. Since the flying speed of the satellite is slow, the satellites are separated from the main droplets and are landed on the recording medium. As a result, degradation in a printing quality such as printing unevenness or ghosting occurs.

The occurrence of the satellite can be prevented by making a driving voltage of the piezoelectric actuator be low. Since when the driving voltage is low, the discharge speed of the main droplets is slow, the satellites do not occur. However, when the discharge speed of the main droplets is slow, stability in discharging of the ink drops is impaired. Therefore, there is concern that the printing quality may be lowered.

DETAILED DESCRIPTION

In general, according to one embodiment, a driving method of an ink jet head includes applying a first pulse for expanding the volume of a pressure chamber in which an ink is accommodated to an actuator for applying oscillation to the pressure chamber and applying a second pulse for reducing the volume of the pressure chamber to the actuator immediately before ink drops discharged from a nozzle which is communicated with the pressure chamber are separated from the nozzle.

First Embodiment

Figure 1:
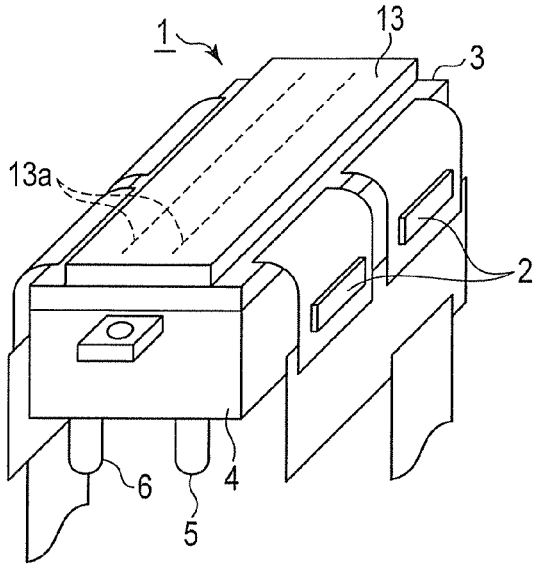
FIG. 1 is a perspective view of an ink jet head.
Figure 2:
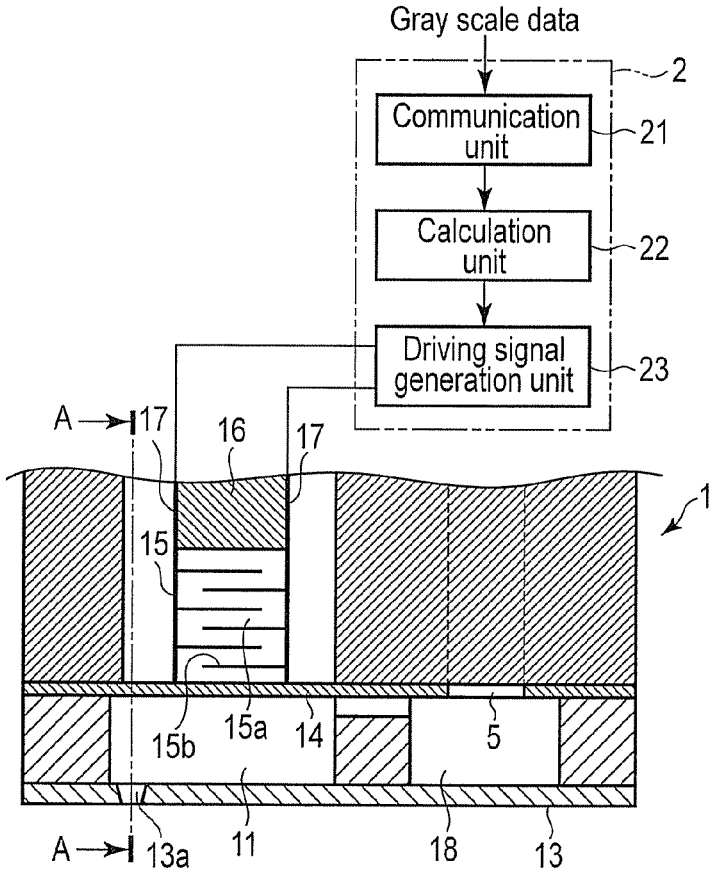
FIG. 2 is a cross-sectional configuration diagram illustrating main portions of the ink jet head.
Figure 3:
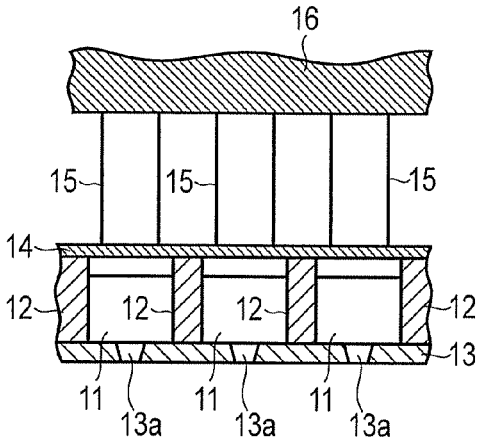
FIG. 3 is a cross-sectional diagram of the ink jet head when seen from a direction taken along A-A line in FIG. 2.

FIG. 1 is a perspective view of an ink jet head 1, FIG. 2 is a cross-sectional configuration diagram illustrating main portions of the ink jet head 1 and FIG. 3 is a cross-sectional diagram illustrating the ink jet head 1 when seen from a direction taken along line A-A in FIG. 2.

The ink jet head 1 includes a driving apparatus 2, a head substrate 3 and manifold 4. The manifold 4 includes a supply tube 5 and an outlet tube 6 of ink. The ink jet head 1 discharges ink supplied from an ink supply unit (not shown) through the supply tube 5 from each of nozzles 13*a* in response to a driving signal from the driving apparatus 2. Ink which is not discharged from each of the nozzles 13*a* of the ink supplied in the manifold 4 from the supply tube 5 is discharged from the outlet tube 6 to the ink supply unit.

The head substrate 3 includes a nozzle plate 13. On the nozzle plate 13, the plurality of nozzles 13*a* for discharging ink drops. Each of the nozzles 13*a* is arrayed in a plurality of rows (two rows in FIG. 1) in a longitudinal direction of the nozzle plate 13.

The head substrate 3 provides a plurality of pressure chambers 11 respectively in parallel and corresponding to each of the nozzles 13*a*. Each of the pressure chambers 11 is partitioned by dividing walls 12 and respectively accommodates the ink. The nozzle plate 13 adheres to the bottom surface side of each of the pressure chambers 11. Each of the nozzles 13*a* shows a tapered shape of which a back surface side, that is, the pressure chamber 11 side becomes tapered toward a front surface side, that is, an ink discharging side.

An oscillation plate 14 adheres to a top surface side of each of the pressure chambers 11. On an upper surface side of the oscillation plate 14, one end of a plurality of piezoelectric members 15 is respectively fixed corresponding to each of the pressure chambers 11. The other end of each of the piezoelectric members 15 is held by a holding member 16. In each of the piezoelectric members 15, a plurality of piezoelectric layers 15*a* and a plurality of electrode layers 15*b* are alternately laminated. A pair of electrodes 17 are disposed so as to interpose each of the electrode layers 15*b*. Both electrodes 17 are electrically connected to the driving apparatus 2.

The head substrate 3 includes a common pressure chamber 18. The common pressure chamber 18 is communicated with each of the pressure chambers 11. The ink is injected to the common pressure chamber 18 through the supply tube 5. The injected ink fills each of the pressure chambers 11 and the nozzles 13*a* corresponding to the pressure chambers 11. By filling ink into the pressure chambers 11 and the nozzles 13*a*, menisci of the ink inside the nozzles 13*a* are formed.

In the ink jet head 1 of such a configuration, when the driving signal is applied to the piezoelectric members 15 through the electrodes 17, the piezoelectric members 15 are expanded or reduced. Accompanying the expansion or the reduction of the piezoelectric members 15, the oscillation plate 14 is transformed to apply oscillation to the pressure chamber 11. Through the oscillation, the volume of the pressure chamber 11 is changed and a pressure wave is generated in the pressure chamber 11. Through the pressure wave, ink drops are discharged from the nozzles 13*a*. Here, the oscillation plate 14 and the piezoelectric members 15 form actuators for applying oscillation to the pressure chamber 11. The ink jet head 1 is provided with the same number of the actuators as the number of the nozzles 13*a*.

Next, the driving apparatus 2 is described. The driving apparatus 2 includes a communication unit 21, a calculation unit 22 and a driving signal generation unit 23. The communication unit 21 receives gray scale data of images to be printed from a host computer for controlling an ink jet printer, for example. The calculation unit 22 calculates the number of driving pulses on the basis of the gray scale data. The driving signal generation unit 23 selectively supplies each of the actuators with the driving signal of the number of the pulses calculated by the calculation unit 22. By applying a voltage of the driving signal to the actuator, the ink drops of the drop numbers corresponding to the pulse numbers are discharged from the nozzles 13*a* of the pressure chambers 11 corresponding to the actuators.

Figure 4:
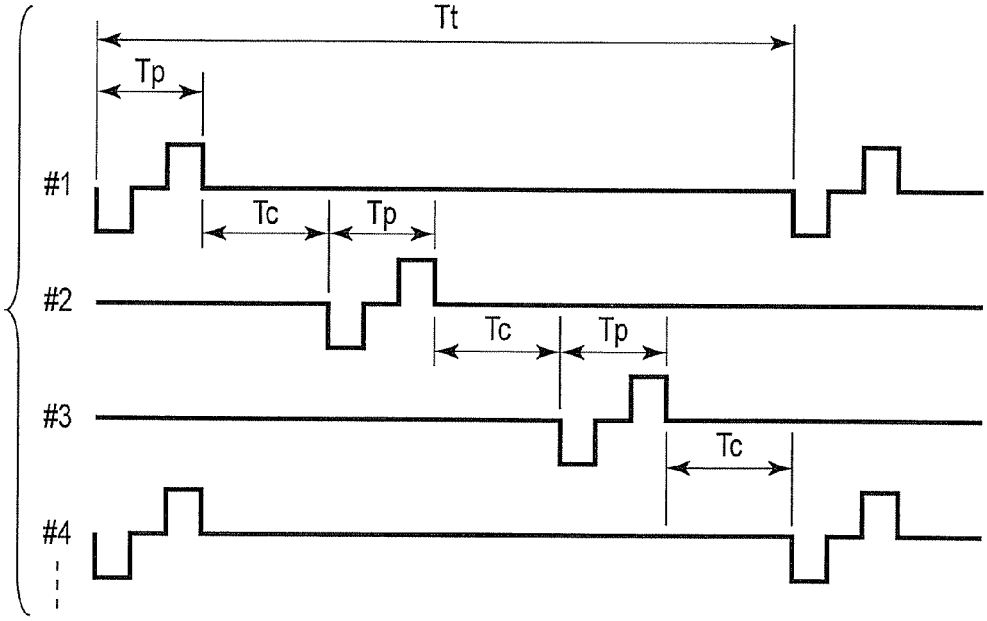
FIG. 4 is a timing diagram of a time division driving signal output from a driving apparatus.

FIG. 4 is a timing diagram illustrating driving signals #1, #2, #3 and #4 which are respectively applied to neighbor actuators. The driving signal #1 is applied to a first actuator. The driving signal #2 is applied to a second actuator which is adjacent to the first actuator. The driving signal #3 is applied to a third actuator which is adjacent to the second actuator. The driving signal #4 is applied to a fourth actuator which is adjacent to the third actuator.

In FIG. 4, a section Tp is a section for discharging one drop of the ink drops from the nozzles 13*a* corresponding to the actuators and is called one drop period. In addition, a section Tc is a delay time of the one drop period Tp respectively applied to the adjacent actuator.

When the ink drops are discharged from all of the nozzles 13*a* at the same time, there are problems such as increasing in calorific values of the driving apparatus 2 and the actuators and increasing in temperature. Therefore, the driving apparatus 2 time-divides one drop period Tp of the signals #1, #2, #3 and #4 within a driving period Tt so as not to discharge the ink drops at least from the adjacent nozzles at the same time. In the example in FIG. 4, there is a case where all of the nozzles 13*a* are divided into groups configured of three nozzles and timings are shifted by three divisions within the group to discharge the ink drops. In the example, the driving period Tt corresponding to nozzles 13*a* within one group becomes [3(Tp+Tc)].

Figure 5:
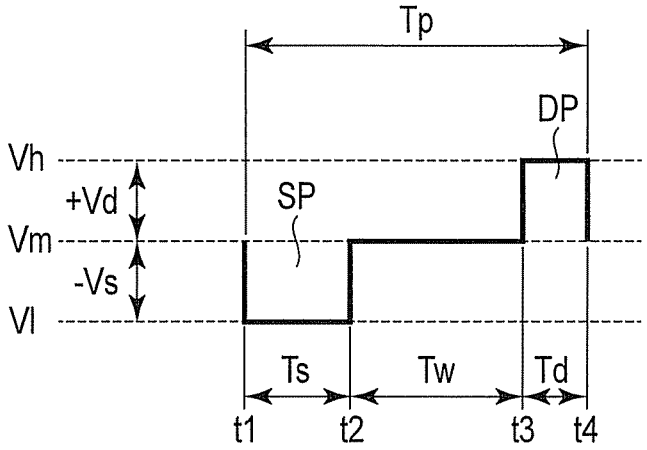
FIG. 5 is an explanatory diagram of a period of one drop of the driving signal.

FIG. 5 is an explanatory diagram illustrating the one drop period Tp of the driving signal. As shown in FIG. 5, the one drop period Tp includes a discharging pulse SP which is the first pulse and a damping pulse DP which is the second pulse. The discharging pulse SP is a pulse which is changed to a voltage V1 which is lower than a reference voltage Vm. The voltage magnitude of the discharging pulse SP is set to −Vs and the pulse width is set to Ts. The damping pulse DP is a pulse which is changed to a voltage Vh which is higher than the reference voltage Vm. The voltage magnitude of the damping pulse DP is set to +Vd and the pulse width is set to Td. In addition, a reference potential Vm is a voltage generally applied to the piezoelectric members 15 in a normal state in which the ink drops are not discharged.

At a time point t1, when the voltage applied to the piezoelectric members 15 is changed from Vm to V1 due to the falling of the discharging pulse SP, the piezoelectric members 15 are reduced than that in the normal state. Along with the reduction, the oscillation plate 14 fixed to the piezoelectric members 15 is changed in shape so as to expand the volume of the pressure chamber 11.

Such volume expansion state continues for a time corresponding to the pulse width Ts of the discharging pulse SP. Then, at a time point t2, when the voltage applied to the piezoelectric members 15 returns from V1 to Vm, the piezoelectric members 15 and the oscillation plate 14 return to the normal state. When returning to the normal state, the volume of the pressure chamber 11 also returns to the normal state.

The normal state continues for a time (t3−t2) corresponding to a section Tw between the discharging pulse SP and the damping pulse DP. Then, at a time point t3, when the voltage applied to the piezoelectric members 15 is changed from Vm to Vh due to the rising of the damping pulse DP, the piezoelectric members 15 expand than that in the normal state. According to the expansion, the oscillation plate 14 fixed to the piezoelectric members 15 is changed in shape so as to reduce the volume of the pressure chamber 11.

The volume reduction state continues for a time corresponding to the pulse width Td of the damping pulse DP. Then, at a time point t4, when the voltage applied to the piezoelectric members 15 returns from Vh to Vm, the piezoelectric members 15 and the oscillation plate 14 return to the normal state. When returning to the normal state, the volume of the pressure chamber 11 also returns to the normal state.

Figure 6:
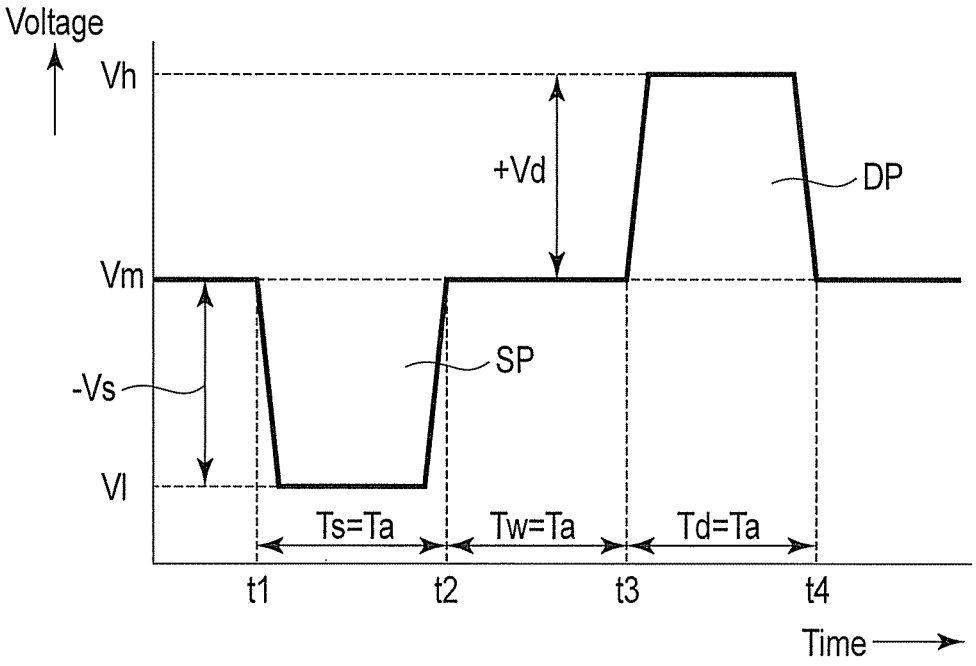
FIG. 6 is a diagram of a pulse waveform of a period of one drop in the related art.

FIG. 6 is a diagram illustrating a waveform of one drop period Tp of a driving signal in the related art. In FIG. 6, a time Ta is a pressure propagation time. The pressure propagation time is defined as ½ of an intrinsic oscillation period of the ink of the pressure chamber 11. In a case shown in FIG. 6, all of a pulse width (electric conduction time) Ts of the discharging pulse SP, a pulse width (electric conduction time) Ds of the damping pulse DP and a section Tw of the discharging pulse SP and the damping pulse DP are set to substantially match the pressure propagation time Ta. Accordingly, the one drop period Tp is 3Ta.

In the example set as described above in the related art, first, the volume of the pressure chamber 11 expands due to the falling of the discharging pulse SP. When the volume of the pressure chamber 11 expands, negative pressure is momentarily generated in the pressure chamber 11. The volume expansion state of the pressure chamber 11 is held for the pulse width Ts of the discharging pulse SP, that is, the pressure propagation time Ta. During a period where the volume expansion state of the pressure chamber 11 is held, the ink is injected to the pressure chamber 11 from the common pressure chamber 18. In addition, the menisci of the leading ends of the nozzles 13*a* retract to the pressure chamber 11 side. Accordingly, the pressure of the pressure chamber 11 is reversed from the negative pressure to positive pressure.

When the pulse width Ts of the discharging pulse SP, that is, the pressure propagation time Ta elapses and the volume of the pressure chamber 11 returns to the normal state, the positive pressure is momentarily generated in the pressure chamber 11. The phase of a pressure wave at this time matches a phase with respect to a pressure wave generated due to the falling of the discharging pulse SP. Accordingly, the amplitude of the pressure wave quickly increases. Through the increase of the amplitude, the menisci within the nozzles 13*a* start to progress.

The progress of the menisci continues until a time corresponding to the section Tw between the discharging pulse SP and the damping pulse DP, that is, the pressure propagation time Ta elapses. Accordingly, the pressure of the pressure chamber 11 is changed from the positive pressure to the negative pressure again.

When the pressure propagation time Ta elapses and the damping pulse DP rises, the volume of the pressure chamber 11 is reduced. When the volume of the pressure chamber 11 is reduced, the positive pressure is momentarily generated in the pressure chamber 11. The phase of the pressure wave at this time is opposed to the phase with respect to the pressure wave generated due to the falling of the discharging pulse SP. Therefore, the pressure of the pressure chamber 11 is attenuated. The pressure attenuation state of the pressure chamber 11 is held for the pulse width Td of the damping pulse DP, that is, the pressure propagation time Ta. During the period where the pressure attenuation state of the pressure chamber 11 is held, the pressure of the pressure chamber 11 is reversed from the negative pressure to the positive pressure.

When the pulse width Td of the damping pulse DP, that is, the pressure propagation time Ta elapses, the volume of the pressure chamber 11 returns to the normal state. When the volume of the pressure chamber 11 returns to the normal state, the negative pressure is momentarily generated in the pressure chamber 11. The phase of the pressure wave at this time is opposed to the phase with respect to the pressure wave generated at a time point of the rising of the damping pulse DP. Accordingly, the pressure of the pressure chamber 11 is further attenuated.

As described above, in the example in the related art, since the pressure oscillation generated by the discharging pulse SP is attenuated by the damping pulse DP, the stable discharging of the ink drops can be achieved. However, it is not even considered regarding the occurrence of the satellite.

Figure 7:
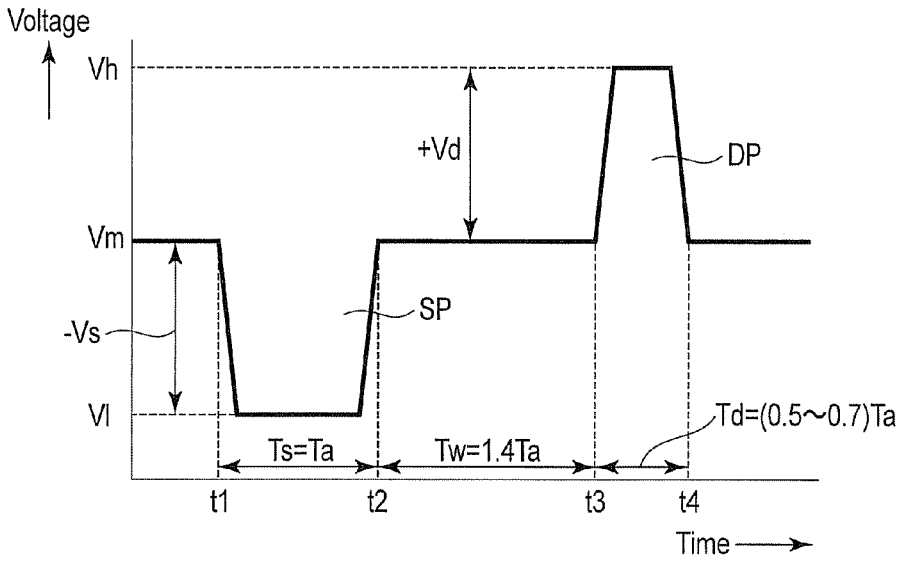
FIG. 7 is a diagram of a pulse waveform of a period of one drop in a first embodiment.
Figure 8:
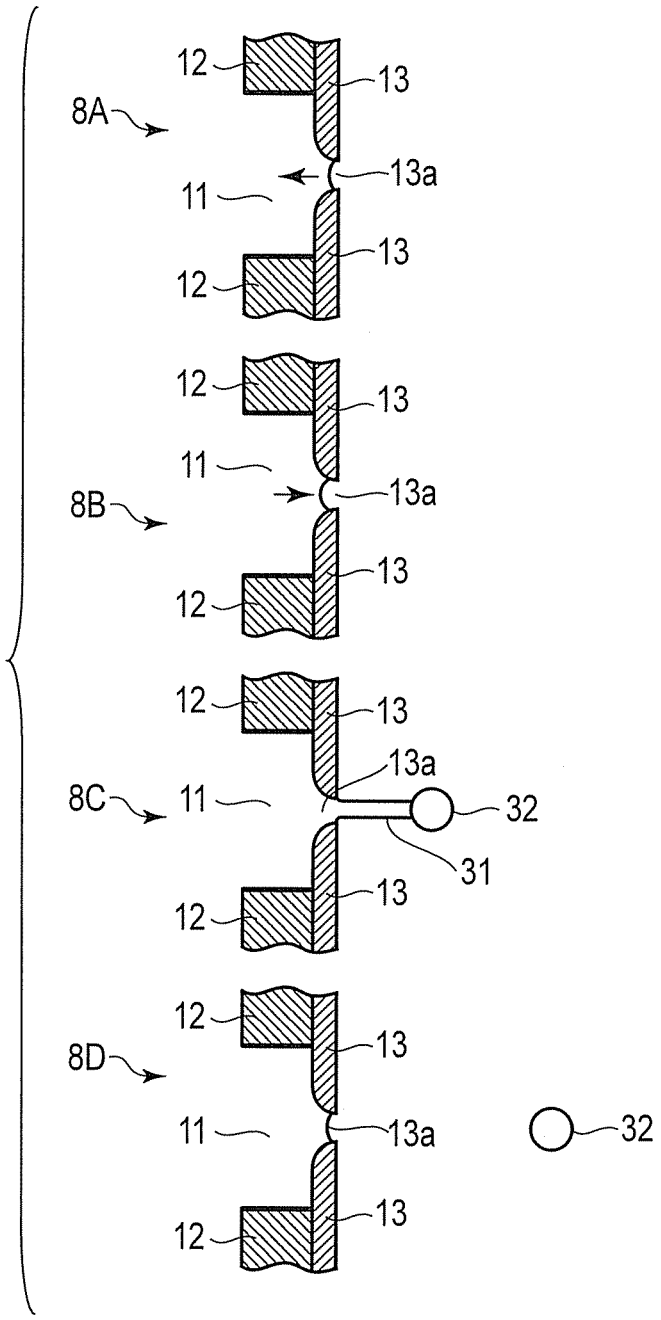
FIG. 8 is a schematic diagram illustrating the movement of the meniscus of ink within a nozzle.

FIG. 7 is a diagram illustrating a pulse waveform of one drop period Tp of a driving signal in the embodiment. As shown in FIG. 7, in the embodiment, the pulse width Ts of the discharging pulse SP is made to substantially match the pressure propagation time Ta. Moreover, the pulse width Ds of the damping pulse DP becomes substantially 0.5 to 0.7 times the pressure propagation time Ta. Furthermore, the section Tw between the discharging pulse SP and the damping pulse DP becomes substantially 1.4 times the pressure propagation time Ta. Movement of the menisci of the ink within the nozzles 13*a* when a driving pulse signal of such a waveform pattern is applied is shown in a schematic diagram in FIG. 8.

First, at a time point t1, when the volume of the pressure chamber 11 expands due to the falling of the discharging pulse SP, the negative pressure is momentarily generated in the pressure chamber 11. The volume expansion state of the pressure chamber 11 continues for the pulse width Ts of the discharging pulse SP, that is the pressure propagation time Ta. During the period where the volume expansion state of the pressure chamber 11 is held, the ink is injected from the common pressure chamber 18 to the pressure chamber 11. Additionally, the menisci of the leading ends of the nozzles 13*a* retract to the pressure chamber 11 side (refer to 8A in FIG. 8). Accordingly, the pressure of the pressure chamber 11 is reversed from the negative pressure to the positive pressure.

Next, when the pressure propagation time Ta corresponding to the pulse width Ts of the discharging pulse SP elapses, at a time point t2, the volume of the pressure chamber 11 returns to the normal state. When the volume of the pressure chamber 11 returns to the normal state, the positive pressure is momentarily generated in the pressure chamber 11. The phase of the pressure wave at this time matches the phase with respect to the pressure wave generated due to the falling of the discharging pulse SP. Accordingly, the amplitude of the pressure wave quickly increases. When the amplitude of the pressure wave quickly increases, the menisci within the nozzles 13*a* start to progress (refer to 8B in FIG. 8).

The progress of the menisci continues until a time corresponding to the section Tw between the discharging pulse SP and the damping pulse DP, that is, a time by 1.4 times the pressure propagation time Ta elapses. Then, when a time by 1.4 times the pressure propagation time Ta elapses, from the rising of the discharging pulse SP, a liquid column 31 of the ink attains a state immediately before separation from the nozzles 13*a* (refer to 8C in FIG. 8).

At a time point t3 immediately before the separation, the volume of the pressure chamber 11 is reduced due to the falling of the damping pulse DP. When the volume of the pressure chamber 11 is reduced, the positive pressure is momentarily generated in the pressure chamber 11. Through the positive pressure, an effect to push the liquid column 31 of the ink acts in the pressure chamber 11. Through the effect, the liquid column 31 is pulled toward the nozzles 13*a* side and is separated from the main droplets. Accordingly, it is possible to prevent the satellite from being formed. In addition, discharge speed of main droplets 32 becomes fast (refer to 8D in FIG. 8).

When the time by 0.5 to 0.7 times the pressure propagation time Ta corresponding to the pulse width Td of the damping pulse DP elapses, at a time point t4, the volume of the pressure chamber 11 returns to the normal state. When the volume of the pressure chamber 11 returns to the normal state, the negative pressure is momentarily generated in the pressure chamber 11. Due to the pressure, remaining pressure oscillation of the pressure chamber 11 is suppressed.

In the embodiment, the section Tw between the discharging pulse SP and the damping pulse DP is set to the time by 1.4 times the pressure propagation time Ta in order to set the section Tw to a time immediately before the ink drops are separated from the nozzles 13*a*. The reason is described as below.

Figure 9:
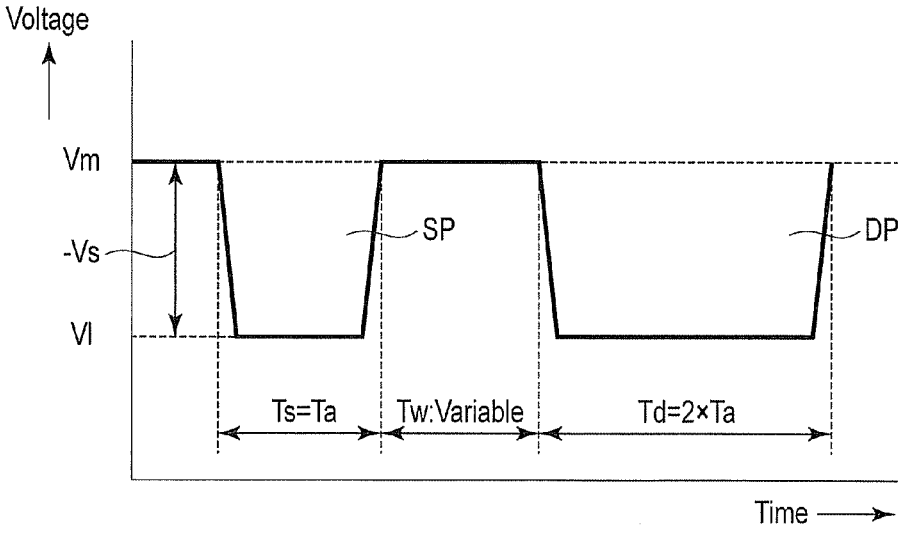
FIG. 9 is a diagram of a pulse waveform used in a test to examine a timing at which a liquid column of ink is separated from a nozzle.

The timing at which the liquid column 31 of the ink is separated from the nozzles 13*a* can be examined by applying a driving signal having a waveform shown in FIG. 9 to the actuator of the ink jet head 1.

In the driving signal in FIG. 9, all of the voltages of the discharging pulse SP and the damping pulse DP are set to constant voltage V1 (22.0 volts) which is lower compared to the reference voltage Vm. The pulse width Ts of the discharging pulse SP is equal to the pressure propagation time Ta. The pulse width Td of the damping pulse DP is two times the pressure propagation time Ta. In other words, the actuator is driven by the damping pulse DP so as to expand the volume of the pressure chamber 11 in the same manner as the discharging pulse SP.

In a test, the section Tw between the discharging pulse SP and the damping pulse DP of the driving signal was allowed to be changed based on the pressure propagation time Ta. Whenever the driving signal in which the section Tw varies was applied to the actuator of the ink jet head 1, the tester measures the discharging speed of the main ink drops 32. The results of the test are shown in the following Table 1.

TABLE 1

| Tw/Ta | Speed (m/s) | Voltage (V) |
|---|---|---|
| 1.0 | 2.3 | 22.0 |
| 1.1 | 1.6 | 22.0 |
| 1.2 | 6.2 | 22.0 |
| 1.3 | 6.7 | 22.0 |
| 1.4 | 6.6 | 22.0 |
| 1.5 | 6.4 | 22.0 |
| 1.6 | 6.4 | 22.0 |
| 1.7 | 6.4 | 22.0 |
| 2.2 | 6.4 | 22.0 |
| 2.6 | 6.4 | 22.0 |

As can be seen from Table 1, when the section Tw between the discharging pulse SP and the damping pulse DP becomes 1.5 times or more the pressure propagation time Ta, the discharging speed of the ink drops 32 is not changed. The fact that the discharging speed of the ink drops 32 is not changed means that the liquid column 31 of the ink is cut from the nozzles 13*a* before the damping pulse DP, sequentially, the ink drops 32 are not affected from the damping pulse DP. Accordingly, when the section Tw between the discharging pulse SP and the damping pulse DP becomes 1.4 times the pressure propagation time Ta, it may mean a time immediately before the ink drops 32 are separated from the nozzles 13*a*.

In addition, in the embodiment, the pulse width Td of the damping pulse DP is set to the time which is 0.5 to 0.7 times the pressure propagation time Ta. The setting time is obtained through the following test.

In other words, in the test, at the one drop period Tp of the driving signal in FIG. 7, the pulse width Td of the damping pulse DP is allowed to be changed based on the pressure propagation time Ta. Whenever the driving signal in which the pulse width Td of the damping pulse DP varies is applied to the actuator of the ink jet head 1, the tester measures a satellite voltage V1 and a satellite speed S1. Moreover, the tester also measures discharging stability limit voltage V2.

The satellite free voltage V1 is a limit voltage at which satellites are not generated. The satellite speed S1 is the discharging speed of the ink drops 32 in the limit voltage at which satellites are not generated. The discharging stability limit voltage V2 is a voltage immediately before the discharge of the ink drops 32 becomes unstable. That is, the discharge becoming unstable means a state where unevenness is incurred in the discharging speed of the ink drops 32 or the ink drops are not discharged.

Here, each of the voltages V1 and V2 shows an average value [(Vs+Vd)/2] of the voltage amplitude Vs of the discharging pulse SP and the voltage amplitude Vd of the damping pulse DP. In addition, the discharge becoming unstable means a state where unevenness of the discharging speed of the ink drops 32 is incurred or the ink drops are not discharged. Furthermore, a phenomenon in which the occurrence or the discharge of the satellite becomes unstable is changed even by driving numbers of various driving patterns, that is, adjacent nozzles. However, the satellite free voltage V1 and the discharging stability limit voltage V2 show the limit voltage in which such phenomenon is not generated even in any of the driving patterns.

The measurement result of the test described above is shown in Table 2. Moreover, as a reference, the measurement result due to the one drop period (FIG. 6) of the driving signal in the related art is also shown in a bottom line of Table 2.

TABLE 2

| Td/Ta | S1 [m/s] | V1 [V] | V2 [V] | V2 – V1 | Speed Evaluation | Voltage Evaluation |
|---|---|---|---|---|---|---|
| 0.3 | 6.4 | 22.6 | 32.0 | 9.4 | X | ○ |
| 0.4 | 7.2 | 22.8 | 32.0 | 9.2 | X | ○ |
| 0.5 | 7.5 | 23.2 | 30.2 | 7.0 | ○ | ○ |
| 0.6 | 7.7 | 23.6 | 27.5 | 3.9 | ○ | ○ |
| 0.7 | 8.0 | 23.9 | 26.4 | 2.5 | ○ | ○ |
| 0.8 | 8.3 | 24.3 | 25.6 | 1.3 | ○ | X |
| 0.9 | 9.0 | 24.9 | 25.4 | 0.5 | ○ | X |
| 1.0 | 6.0 | 22.2 | 32.0 | 9.8 | X | ○ |

As can be seen from Table 2, the higher the pulse width Td of the damping pulse DP increases, the higher the satellite free speed S1 and the satellite free voltage V1 increase. When the satellite free speed S1 increases, the shift of landing due to variations in the discharging speed for every nozzle caused during the manufacturing or the like decreases. However, the higher the pulse width Td increases, the lower the discharging stability limit voltage V2 decreases. Therefore, a voltage margin (V2–V1) between the discharging stability limit voltage V2 and the satellite free voltage V1 becomes narrower and discharging stability is impaired.

In Table 2, fields of [speed evaluation] are denoted with a suitable symbol "O" when the satellite free speed S1 is 7.5 [m/s] or more and with an unsuitable symbol "X" when the satellite free speed S1 is less than 7.5 [m/s]. Moreover, fields of [voltage evaluation] are denoted with the symbol "O" expressing it is suitable when the voltage margin (V2–V1) is 2.5 [V] or more and the symbol "X" expressing it is not suitable when the voltage margin is less than 2.5 [V].

As a result, in the waveform of the one drop period shown in FIG. 7, the pulse width Td of the damping pulse DP is set to 0.5 to 0.7 times the pressure propagation time Ta and an average voltage between the voltage Vs of the discharging pulse SP and the voltage Vd of the damping pulse DP is set to a limit satellite voltage V1 at which satellites are not generated. By doing so, the satellite free speed S1 can increase and sufficient voltage margin can be secured. That is, sufficient discharging stability can be achieved.

In other words, by setting the pulse width Td of the damping pulse DP to 0.6 times the pressure propagation time Ta, the one drop period Tp becomes 3Ta through the following formula (1). The value is equal to the one drop period Tp in the related art shown in FIG. 6. That is, it is possible to discharge the ink in the same driving frequency as that in the related art.

$$T=Ts+Tw+Td=Ta+1.4\ Ta+0.6\ Ta=3\ Ta \quad (1)$$

As described above, according to the embodiment, an effect in which the occurrence of the satellite can be suppressed without damaging the discharging stability of the main droplets can be achieved.

However, there is a case where variation in the discharging speed of each nozzle caused during the manufacturing or the like is incurred. Due to the variation, there is concern that landing locations of the main droplets of each nozzle may be shifted and printing quality is lowered. Moreover, the landing shifts depend on transport speed of the medium. That is, the higher the transport speed increases, the larger the landing shifts. Accordingly, it is not possible to increase the transport speed of the medium by lowering the driving frequency of the ink jet head. Therefore, printing speed is delayed and productivity is degraded.

In general, the flying speed of the satellite is later than the main droplets and even when the driving waveform or the voltage is changed, the speed may not increase. Therefore, particularly when a gap is wide, the landing shifts from the main droplets become noticeable. Additionally, the satellite, that is, the fine droplets may be easily affected from airflow according to the relative movement of the head and the medium. Due to the influence, concentration unevenness such as wind ripple and the printing quality is noticeably impaired.

In such an ink jet head, when ink is discharged from all of the nozzles at the same time at once, there are problems of temperature increase in a driving circuit and the head. Therefore, there is a method for shifting a timing and controlling in a time division manner. However, in addition to the problems of the satellite, there is a problem regarding the landing shifts of so-called cross-talk, in which the discharging speed is changed depending on whether or not the ink is discharged from the adjacent nozzles and the printing quality is degraded.

Next, another embodiment is described in which a driving waveform at which satellites are not generated is applied without decreasing the discharging speed of the main droplets, degrading the discharging stability and further without lowering the driving frequency and by suppressing the landing shifts due to the variations in the satellite and each of the nozzles and the cross-talk, high quality printing can be performed at higher speeds.

Second Embodiment

Figure 10:
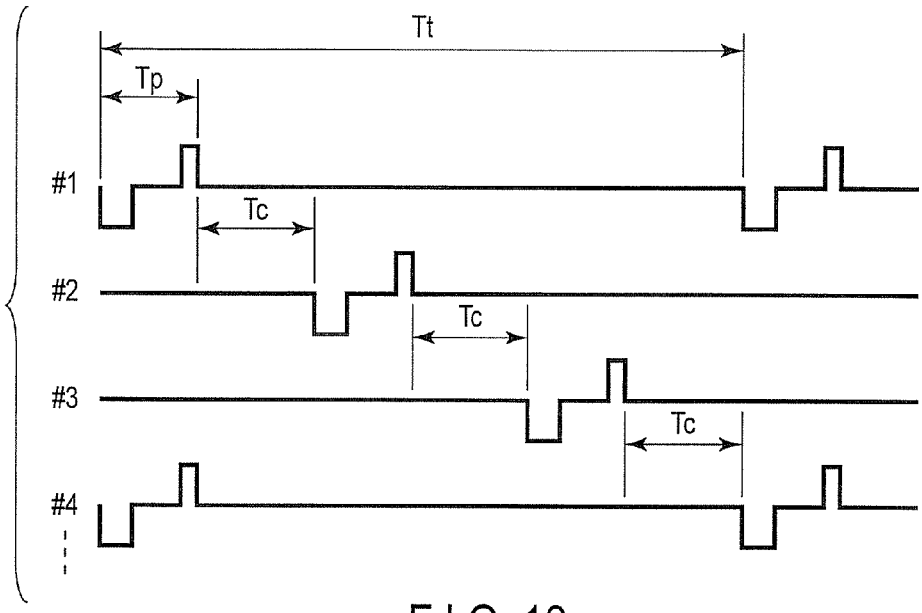
FIG. 10 is a timing diagram of a time division driving signal of a second embodiment.

FIG. 10 is a timing diagram illustrating the driving signals #1, #2, #3 and #4 when the pulse width Td of the damping pulse DP is set to a time which is 0.5 to 0.7 times the pressure propagation time Ta. As described above, the driving period Tt with respect to one nozzle 13*a* is [3(Tp+Tc)]. Accordingly, a driving frequency F is [1/Tt], which is the reverse of Tt. In order to realize high speed printing, the driving frequency F may increase.

By reducing a delay time Tc, the driving frequency F can increase. However, when the delay time Tc is shortened, there is concern that the printing quality may be degraded due to the cross-talk phenomenon. The cross-talk phenomenon means a phenomenon in which due to the influence of remaining oscillation of the nozzle 13*a* from which the ink drops are discharged at the immediately preceding timing, the discharging speed of the adjacent nozzle 13*a* which discharges the ink drops at the next timing is changed.

The pressure of the pressure chamber 11 corresponding to the nozzle 13*a* from which the ink drops are discharged at the immediately preceding timing is oscillated according to the intrinsic oscillation period (2Ta) of the ink within the pressure chamber thereof. The oscillation is propagated to the pressure chamber 11 corresponding to the adjacent nozzle 13*a* from which the ink drops are discharged at the next timing through the dividing wall 12. As a result, the speed of the ink discharged from the adjacent nozzle 13*a* is changed. Here, in the second embodiment, in time division driving shown in FIG. 10, by setting the delay time Tc to an appropriate value, the occurrence of the satellite is suppressed and the influence of the cross-talk is also improved.

Figure 11:
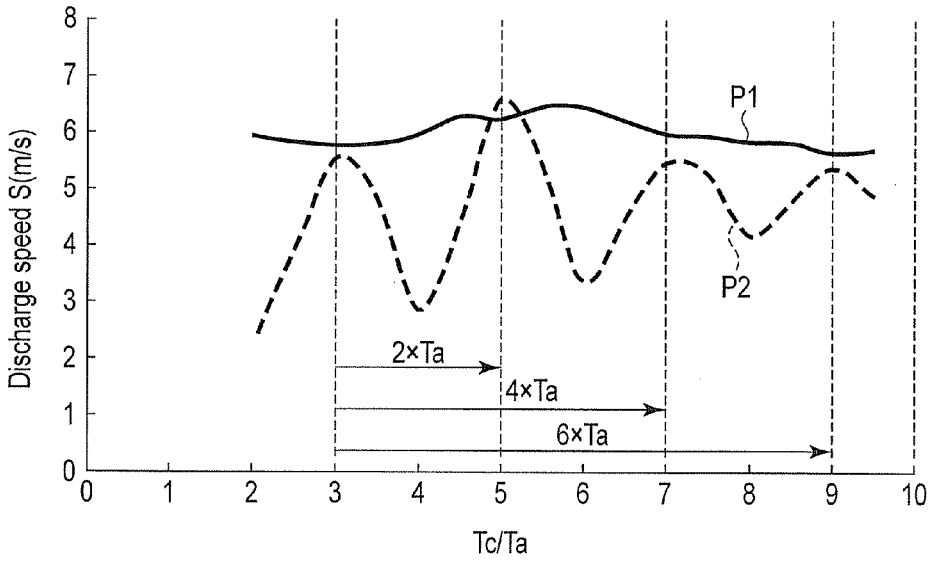
FIG. 11 is a graph illustrating a corresponding relationship between discharge speed and a delay time.

FIG. 11 is a graph illustrating a corresponding relationship between the delay time Tc and the discharging speed S [m/s]. In FIG. 11, the horizontal axis shows a value Tc/Ta in which the delay time Tc is divided by the pressure propagation time Ta and the vertical axis shows discharging speed S [m/s]. Moreover, a solid line P1 shows a corresponding relationship between the value Tc/Ta and the discharging speed S when only one nozzle independently discharges the ink, a so-called time of single nozzle driving. A dashed line P2 shows a corresponding relationship between the value Tc/Ta and the discharging speed S when all of the nozzles discharge the ink, a so-called time of all of the nozzles driving.

As shown in FIG. 11, when all of the nozzles are driven, the discharging speed S is considerably changed periodically. As described above, it is considered that the periodical change of the discharging speed S is caused due to the influence of the cross-talk. In other words, if the discharging speed S when all of the nozzles are driven becomes close to the discharging speed S when a single nozzle is driven, it is considered that the influence of the cross-talk is lowered.

When all of the nozzles are driven, if the value Tc/Ta is "3", "5", and "7" and so on, the value becomes close to the discharging speed S when the single nozzle is driven. Accordingly, by setting the delay time Tc to a value calculated from the following formula (2), the influence of the cross-talk can be lowered.

$$Tc=(1+2n)*Ta \quad (n \text{ is a natural number such as 1, 2, 3 and so on}) \tag{2}$$

In particular, when n=1, that is, delay time Tc=3Ta is set, the driving frequency F becomes higher. That is, it is possible to realize the printing at the higher speed. In addition, when the delay time Tc is set to be less than 3Ta, the discharge becomes unstable. Therefore, it is not preferable to set the delay time Tc to be less than 3Ta.

Third Embodiment

In the second embodiment, the influence of the cross-talk is lowered by setting the delay time Tc to be an appropriate value. In a third embodiment, the influence of the cross-talk is lowered through another method.

Figure 12:
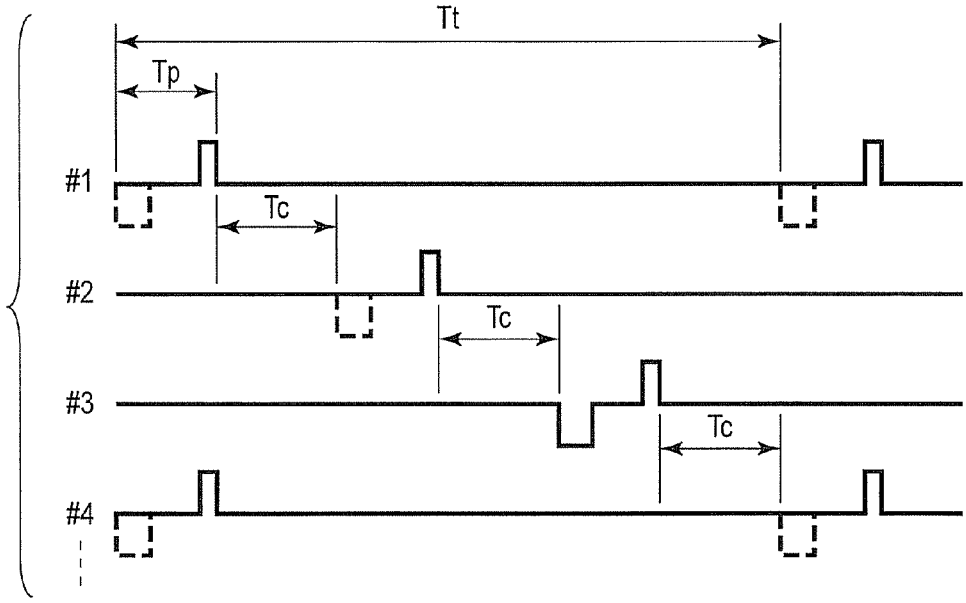
FIG. 12 is a timing diagram of a time division driving signal of a third embodiment.

FIG. 12 is a timing diagram illustrating driving signals #1, #2, #3 and #4 in the third embodiment and shows a case where the ink is discharged from the nozzles 13*a* to which the driving signal #3 is applied. As shown in FIG. 12, in the third embodiment, with respect to the nozzles from which the ink is not discharged, the discharging pulse SP is not output. As described above, a driving waveform in which the discharging pulse SP is not output during one drop period and only the damping pulse DP is output is called a dummy pulse. When the dummy pulse is applied to the actuator, a minute oscillation in which the ink drops are not discharged with respect to the pressure chamber 11 is applied.

Figure 13:
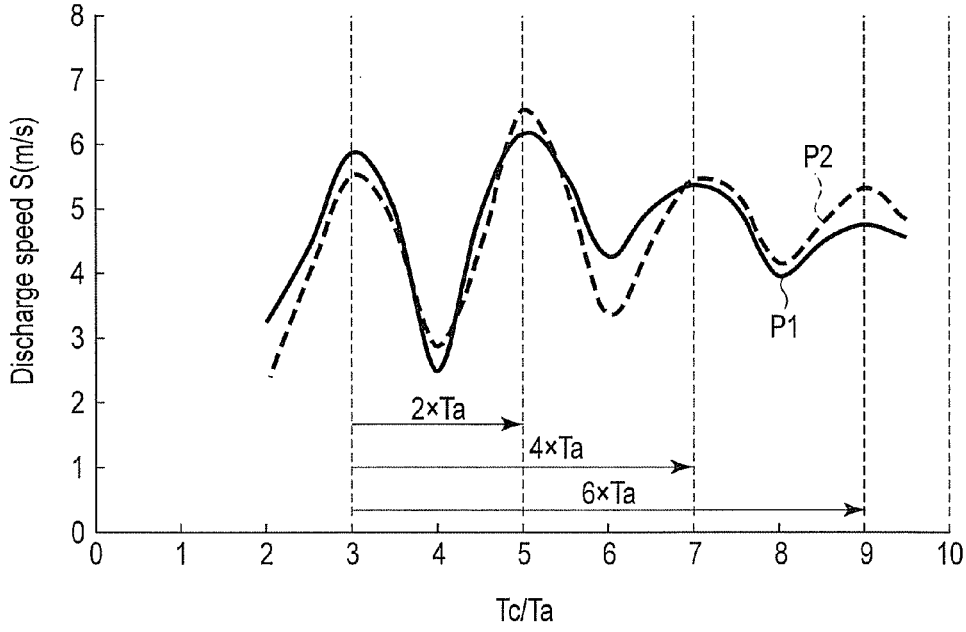
FIG. 13 is a graph illustrating a corresponding relationship between discharge speed and a delay time.

FIG. 13 is a graph illustrating a corresponding relationship between the delay time Tc and the discharging speed S [m/s] and common portions in FIG. 11 are given the same reference numerals. As shown in FIG. 13, by using the dummy pulse, the discharging speed due to the influence of the cross-talk when the single nozzle is driven is periodically changed in the same manner as that when all of the nozzles are driven. The difference of the discharging speed between when all of the nozzles are driven and when the single nozzle is driven becomes smaller.

Therefore, the influence of the cross-talk is lowered by using the dummy pulse. In addition, by setting the delay time Tc to a value calculated through the formula (2) in the same manner as that of the second embodiment, the discharging speed can increase. In addition to the above, when n=1, that is, delay time Tc=3Ta is set, the driving frequency F can be higher, that is, printing at the higher speed can be realized.

Here, the present invention is not limited to the embodiments.

For example, in the embodiment, the section Tw between the discharging pulse SP and the damping pulse DP is set to be 1.4 times the pressure propagation time Ta, however, the value is not particularly limited. The main point is that after the discharging pulse SP is applied to the actuator, the damping pulse DP may be applied to the actuator immediately before the ink drops are separated from the nozzles.

In addition, in the embodiment, the driving apparatus and the driving method with respect to the ink jet head 1 of the structure shown in FIG. 1 are described, however, the technique can be applied to a driving apparatus and a driving method with respect to ink jet head 1 of other structures in the same manner. Furthermore, the technique is not limited to the ink jet head which drives each of the nozzles by time division.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving pulse application method of an ink jet head which applies oscillation to a pressure chamber in which ink is accommodated by an actuator and which causes ink drops to be discharged from nozzles communicated with the pressure chamber, comprising:

applying a first pulse to the actuator in order to expand volume of the pressure chamber, keep expanded volume of the pressure chamber for a predetermined period of time, and then restore the pressure chamber to an original volume; and a predetermined time after application of the first pulse, applying a second pulse in order to reduce the volume of the pressure chamber, keep reduced volume of the pressure chamber for a predetermined length of time, and then restore the pressure chamber to the original volume, immediately before the ink drops are separated from the nozzle.

2. The method of claim 1, wherein a pulse width of the first pulse is equal to ½ of an intrinsic oscillation period of the ink within the pressure chamber and an interval between the first pulse and the second pulse is 1.4 times ½ of the intrinsic oscillation period.

3. The method of claim 2, wherein a pulse width of the second pulse is 0.5 to 0.7 times ½ of the intrinsic oscillation period.

4. The method of claim 3, further comprising:

setting delay times of discharging timings when the ink drops are discharged in a time division manner from adjacent nozzles to (1+2n) times ½ of the intrinsic oscillation period, given that, n is a natural number such as 1, 2, 3.

5. The method of claim 3, further comprising:

applying only the second pulse to the actuator without applying the first pulse with respect to the nozzles from which the ink is not discharged when the ink drops are discharged in a time division manner from the adjacent nozzles.

6. The method of claim 2, wherein the average voltage of the voltage of the first pulse and the voltage of the second pulse is a limit satellite free voltage at which satellites are not generated.

7. A driving apparatus of an ink jet head comprising:

the ink jet head which applies oscillation to a pressure chamber in which ink is accommodated by an actuator and which causes ink drops to be discharged from nozzles communicated with the pressure chamber; and a driving signal generation unit which applies a first pulse to the actuator in order to expand the volume of the pressure chamber, keep expanded volume of the pressure chamber for a predetermined period of time, and then restore the pressure chamber to an original state, and which, a predetermined time after application of the first pulse, applies a second pulse in order to reduce the volume of the pressure chamber, keep reduced volume of the pressure chamber for a predetermined length of time, and then restore the pressure chamber to the original volume, immediately before the ink drops are separated from the nozzle.

8. The apparatus of claim 7, wherein the driving signal generation unit outputs a driving signal in which a pulse width of the first pulse is set to be equal to ½ of an intrinsic oscillation period of the ink within the pressure chamber and an interval between the first pulse and the second pulse is set to 1.4 times ½ of the intrinsic oscillation period.

9. The apparatus of claim 8, wherein the driving signal generation unit sets the pulse width of the second pulse to 0.5 to 0.7 times ½ of the intrinsic oscillation period.

10. The apparatus of claim 8, wherein the driving signal generation unit sets average voltage of the voltage of the first pulse and the voltage of the second pulse to a limit satellite free voltage at which satellites are not generated.

* * * * *